US009126249B2

(12) United States Patent
Benedetti et al.

(10) Patent No.: US 9,126,249 B2
(45) Date of Patent: Sep. 8, 2015

(54) ZEROING SYSTEM OF A ROLLING STAND

(75) Inventors: Gianpietro Benedetti, Tricesimo (IT); Luca Sandrin, Terzo di Aquileia (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 297 days.

(21) Appl. No.: 13/261,524

(22) PCT Filed: May 26, 2011

(86) PCT No.: PCT/IB2011/052295

§ 371 (c)(1),
(2), (4) Date: Nov. 21, 2012

(87) PCT Pub. No.: WO2011/148335

PCT Pub. Date: Dec. 1, 2011

(65) Prior Publication Data

US 2013/0086964 A1 Apr. 11, 2013

(30) Foreign Application Priority Data

May 26, 2010 (IT) ..... MI2010A0944

(51) Int. Cl.

| | |
|---|---|
| ***B21B 13/00*** | (2006.01) |
| ***B21B 38/10*** | (2006.01) |
| *B21B 27/02* | (2006.01) |
| *B21B 31/16* | (2006.01) |
| *B21B 31/18* | (2006.01) |

(52) U.S. Cl.

CPC ..... *B21B 13/00* (2013.01); *B21B 38/105* (2013.01); *B21B 27/021* (2013.01); *B21B 31/16* (2013.01); *B21B 31/18* (2013.01); *B21B 2267/06* (2013.01); *B21B 2269/14* (2013.01)

(58) Field of Classification Search

CPC ..... B21B 38/10; B21B 38/105; B21B 27/02; B21B 27/021; B21B 2027/022; B21B 13/142; B21B 13/00

USPC ..... 72/252.5, 247, 226, 229; 492/15, 47

See application file for complete search history.

(56) References Cited

U.S. PATENT DOCUMENTS 4,202,192 A * 5/1980 Haneda et al. ..... 72/14.1

FOREIGN PATENT DOCUMENTS

| | | |
|---|---|---|
| DE | 10027721 | 12/2001 |
| EP | 0248605 | 12/1987 |
| JP | 59191511 | 10/1984 |
| JP | 10071410 | 3/1998 |

* cited by examiner

*Primary Examiner* — Shelley Self
*Assistant Examiner* — Gregory Swiatocha
(74) *Attorney, Agent, or Firm* — Stetina Brunda Garred & Brucker

(57) ABSTRACT

A zeroing system of a rolling stand which allows to replace the working cylinders or rolls in a four-high rolling stand for hot rolling strips and to subsequently zero the rolling stand without removing the strip from between the rolls themselves during the step of rolling. Furthermore, the system of the invention allows to very rapidly and accurately carry out the zeroing operation, thus increasing the productivity in the entire production system.

13 Claims, 4 Drawing Sheets

ZEROING SYSTEM OF A ROLLING STAND

FIELD OF THE INVENTION

The present invention relates to a zeroing system of a rolling stand, particularly suitable for zeroing the rolling stand in hot rolling plants without interrupting the rolling process itself.

STATE OF THE ART

In rolling plants, the working and/or supporting rolls of the rolling stands must be periodically replaced due to wear.

After replacement, the rolling stand must be zeroed, i.e., the precise position at which the respective surfaces of the upper working roll and the lower working roll come into contact must be defined according to the diameter of the rolls present in the rolling stand (working rolls and supporting rolls). Furthermore, this is needed to guarantee a correct value of the rolled product thickness, at the outlet of the rolling stand, which must be within the required tolerances.

The possibility of zeroing working rolls with material between the rolls is applied in strip cold rolling mills or in process lines by manually placing blocks on the fittings (two on each side) because in this case, operating conditions are favorable, or alternatively, the cold strip is stopped, by virtue of the presence of loopers, which work as upstream and downstream buffers, while the working rolls are changed and the subsequent zeroing is carried out by putting said working rolls in contact with the strip itself. Both methods have some disadvantages: the first method does not allow one to take into account the clearance between mechanical parts (e.g., bearings, adjustment screws etc.) in the zeroing process, and the second method causes strip portions, the thickness of which may be out of tolerance.

In the case of Hot Strip Mills (HSM), this operation is more complex because the hot strip cannot be stopped, because of the absence of loppers and because of the risk of damaging the working rolls caused by local temperature increase of the same rolls in contact with the high temperature material to be rolled, and because of the risk of decreasing the temperature which could be insufficient for the passes through the subsequent rolling stands.

The traditional solution contemplates, for hot rolling plants, to change the rolls in a rolling stand and to zero said stand without the presence of rolling material between the working rolls, by putting the surface of the lower working roll into contact with that of the upper working roll. This necessarily implies stopping the rolling mill and, in lack of an upstream buffer, the casting as well. It is thus felt the need to make a zeroing system of the rolling rolls in a rolling stand which allows one to overcome the aforesaid drawbacks.

SUMMARY OF THE INVENTION

It is a main object of the present invention to make a zeroing system of a rolling stand which allows one to replace the working and/or supporting cylinders or rolls in a four-high rolling stand for hot rolling strips and to subsequently zero the rolling stand without removing or stopping the strip between the rolls themselves.

A further object of the invention is to make a zeroing system of a rolling stand which further allows one to very rapidly and accurately carry out the zeroing operation, allowing one to increase productivity in the entire plant.

A further object of the present invention is to provide a zeroing process of a rolling stand.

The present invention thus aims at reaching the objects discussed above by means of a zeroing system of a rolling stand which, according to claim 1, comprises:

a first working roll defining a first longitudinal axis, a second working roll defining a second longitudinal axis, wherein each of said first working roll and second working roll is provided at a first end with a respective annular protrusion having a first diameter larger than a second diameter of the working roll at a respective rolling surface, and is provided at a second end with a respective annular recess having a third diameter smaller than said second diameter.

and wherein said first working roll and second working roll are configured so that in a rolling position, the annular protrusion of the first working roll is placed at the annular recess of the second working roll, while the annular protrusion of the second working roll is placed at the annular recess of the first working roll, and in a zeroing position of said working rolls, the annular protrusion of the first working roll is in contact with the rolling surface of the second working roll, while the annular protrusion of the second working roll is in contact with the rolling surface of the first working roll, whereby a material to be rolled may continue to cross a gap between said first and second working rolls without being rolled.

A second aspect of the present invention provides a rolling stand comprising the aforesaid zeroing system.

A third aspect of the present invention provides a zeroing process of the position of the working rolls of a rolling stand which comprises the following steps:

a) inserting said first working roll and second working roll into the rolling stand in a rolling position;

b) translating at least one of said first working roll and said second working roll along the respective longitudinal axis for a predetermined length until reaching a predetermined axial shifting between the working rolls whereby said zeroing position is reached.

In accordance with the present invention, a ring or collar of a diameter larger than that of the working roll is either made on, or applied to a first end of the working rolls, while a groove is made in the second end.

During rolling, with the material between the two working rolls, the ring of one of the two working rolls is at the groove of the other coupled working roll. In this manner, the upper working roll and the lower working roll can be positioned, under limit conditions, with the liners or rolling surfaces in contact.

When zeroing is needed, one of the two working rolls (either the upper one or the lower one) or both rolls are axially translated by a predetermined length, using appropriate translation means, so that the ring of one working roll comes into contact with the liner of the working roll coupled thereto, even if material, i.e., the strip, is present between the two working rolls.

Said translation means allow translation of at least one of said first working roll and second working roll along the respective longitudinal axis so as to pass from the rolling position to the zeroing position, or vice versa.

Therefore, the solution according to the invention allows changing rolls, and subsequently zeroing one or more rolling stands at the same time, by shifting the working rolls and using the ring-shaped locator members, while the other rolling stands are continuing to roll.

The value of the outer diameter of the ring and of the diameter of the groove are appropriately defined during the step of designing according to the thickness of the material to be rolled.

After having replaced the working rolls, roll shop grinding can be carried out on the worn working rolls, whereby the diameter of the ring is ground along with the diameter of the liner of the working roll to always guarantee a correct alignment and a correct concentricity of the ring with respect to the liner of the working roll and to maintain coherence between the values of the two diameters in all working conditions of the rolling stand.

Advantageously, the system and the process of the invention imply a series of advantages with respect to the traditional solution of the prior art, in particular:

possibility of zeroing the rolling stand by means of contact of the working rolls without in all cases removing the strip from between the rolls themselves. This allows one to not interrupt the rolling process with the nearby rolling stands but simply to bypass the rolling stand concerned by the roll change, and in particular to not interrupt the casting process in case of endless rolling;

possibility of replacing the working rolls without interrupting the hot rolling process may be useful particularly in an endless process in the following cases: 1) emergency change in a rolling stand due to damaged working rolls; 2) change in one or more rolling stands when wear limit is reached;

possibility of continuing rolling with a lower number of rolling stands. In this case, productivity of the plant is increased because, although with greater output material thickness, the production may continue also during a roll change step, while with traditional solutions in said step production is stopped.

Preferably, but not necessarily, working rolls are changed one rolling stand at a time. While the working rolls are being changed, the respective rolling stand, which is provided with, in all cases, an auxiliary roll system to maintain the material pass-line at a constant condition, is dummy, and the rolling process continues with one less active rolling stand, in all cases for a very short time.

By extracting the working rolls of a rolling stand, both the transient of the thickness change between rolling stands and the loop of the strip between the previous rolling stand and the next one can be easily managed.

In a conventional coil-to-coil process, if production is carried out in the rolling mill only, the solution according to the invention allows an increase in productivity.

The dependent claims describe preferred embodiments of the invention.

BRIEF DESCRIPTION OF THE FIGURES

Further features and advantages of the invention will be more apparent in the light of the detailed description of a preferred, but not exclusive, embodiment, of a zeroing system of a rolling stand illustrated by way of non-limitative example, with reference to the accompanying drawings, in which.

The same reference numbers in the figures identify the same elements or components.

DETAILED DESCRIPTION OF A PREFERRED EMBODIMENT OF THE INVENTION

Figure 1:
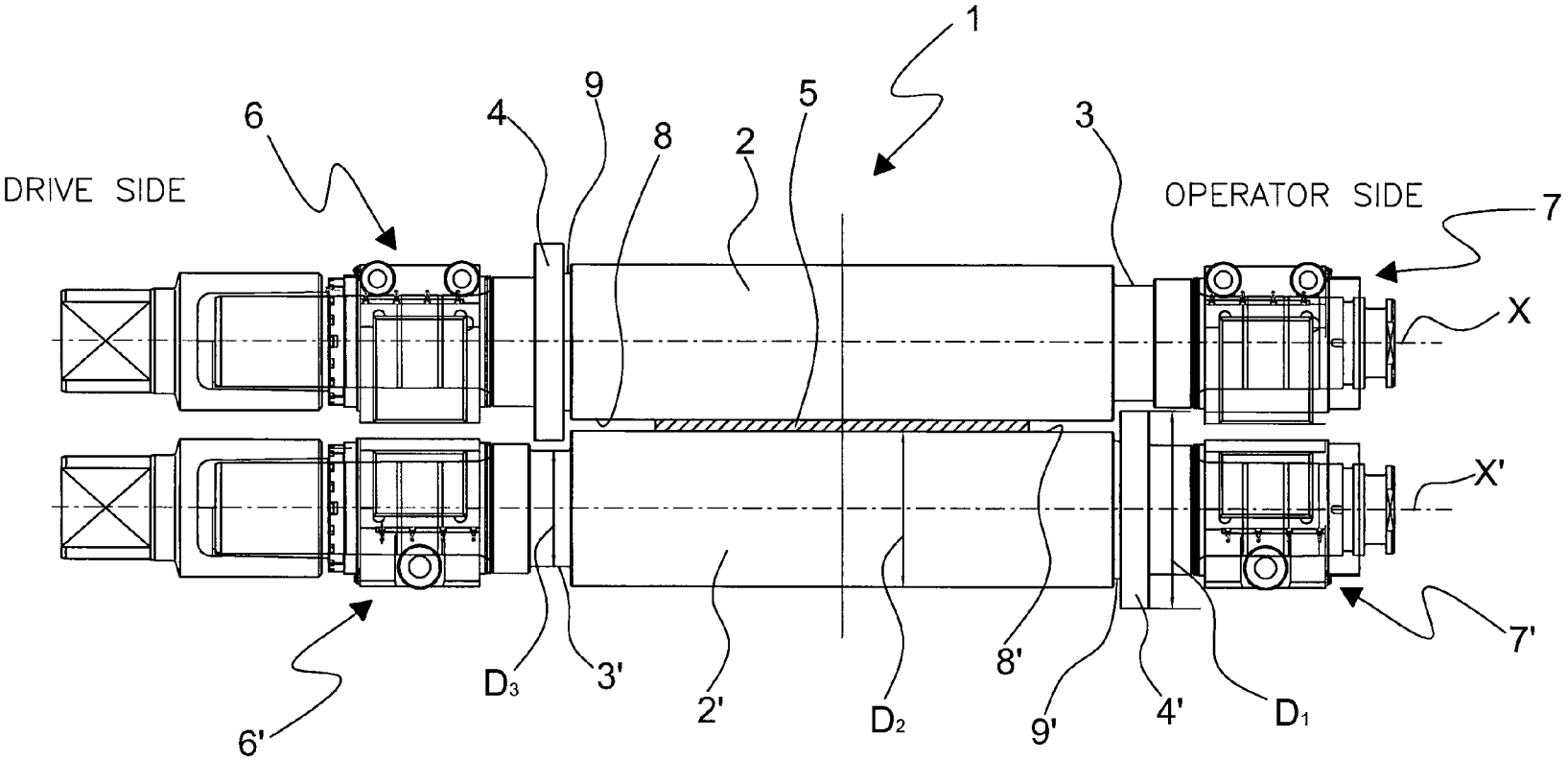
FIG. 1 is a view of the working rolls of a rolling stand according to the invention in rolling position.

The figures show a preferred embodiment of a zeroing system of a rolling stand, globally indicated by reference number 1, for allowing zero adjusting or zeroing of the rolling stand after changing the working and/or supporting rolls in the presence of a metallic strip crossing the rolling stand.

According to one embodiment, the zeroing system of a rolling stand comprises:

an upper working roll 2 provided at a first end with an annular protrusion or ring or collar 4, having a diameter D1 larger than a diameter D2 of the rolling surface or liner 8 of the same upper working rolling 2, and provided at a second end with a groove 3 having a diameter D3 smaller than said diameter D2;

a lower working roll 2' provided at a first end with an annular protrusion or ring or collar 4', having a diameter D1 larger than a diameter D2 of the rolling surface or liner 8' of the same lower rolling roll 2', and provided at a second end with a groove 3' having diameter D3 smaller than said diameter D2;

moving means of the working rolls 2, 2', adapted to transmit to the working rolls 2, 2' at least one translation motion along the respective longitudinal axis X, X'.

Such moving means comprise, for example, known shifting devices 10 provided with hydraulic cylinders. In all cases, other types of known moving means may be provided.

Such shifting devices 10, generally one for each working roll, may be fitted either on drive side or operator side. They are normally fitted on the same rolling stand. Rings, liners and grooves of the working rolls are appropriately coaxial to one another.

Figure 3:
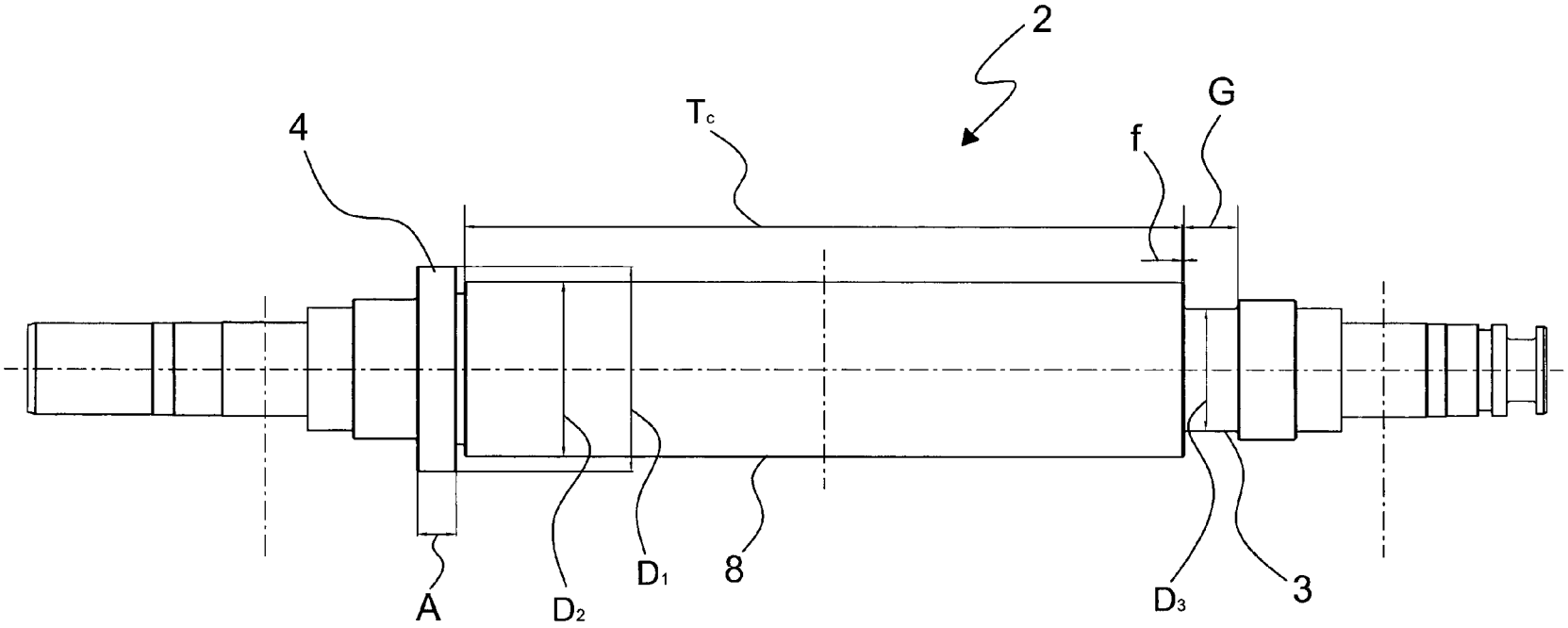
FIG. 3 is a view of a working roll of the zeroing system according to the invention.
Figure 4:
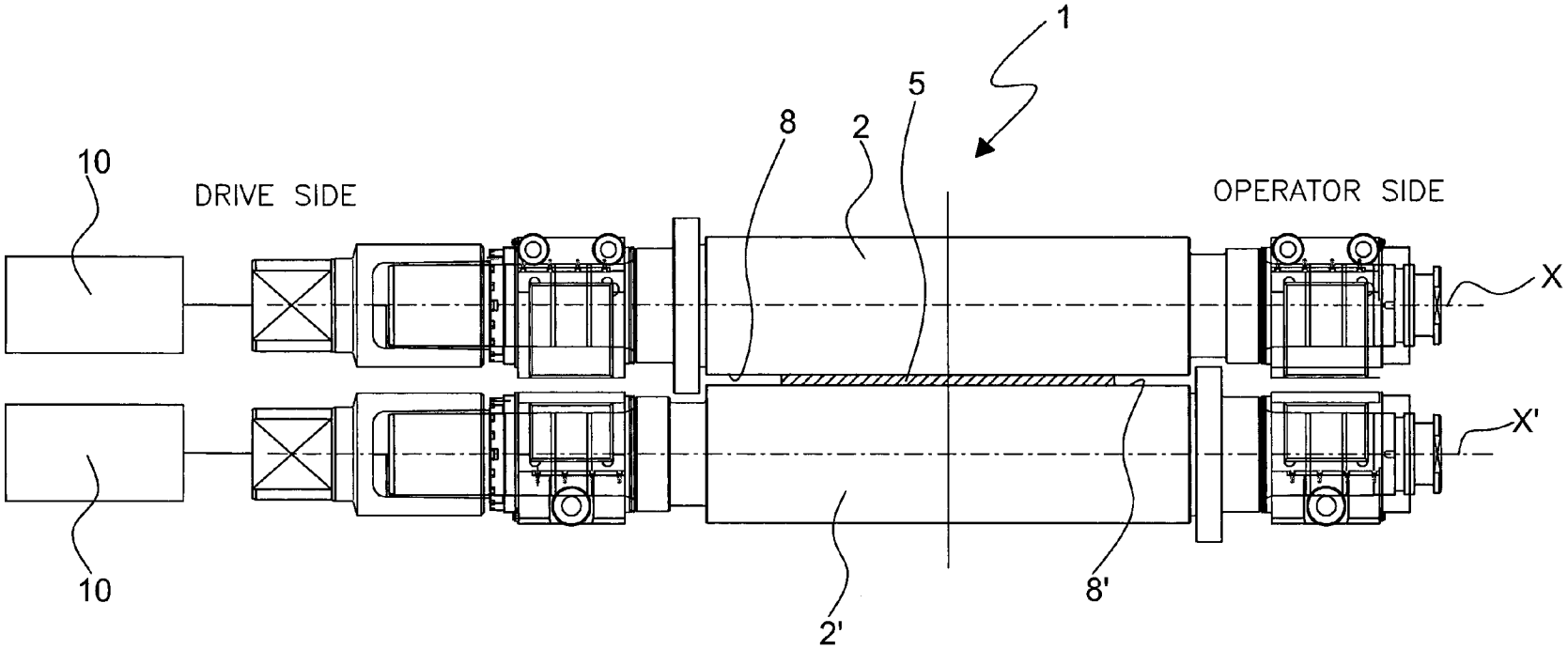
FIG. 4 is a view of the working rolls provided with translation means, diagrammatically shown.

The working rolls comprising rings 4, 4' and grooves 3, 3' are preferably made in one piece. In this case, both rings and grooves are obtained together with the roll as shown in FIG. 3. Alternatively, the rings or collars 4, 4' may be subsequently inserted by means of mechanical assembly. For example, the rings may be fitted by interference or by means of locking members, such as a tongue.

The working rolls 2, 2' are supported by respective fittings 6, 6' on a drive side and by respecting fittings 7, 7' on an operator side.

Advantageously, the working rolls 2, 2' of the rolling stand are configured so that in a working position, i.e., in a rolling position with the strip 5 crossing the rolling stand (FIG. 1), the ring 4 of the upper working roll 2 is positioned at the groove 3' of the lower working roll 2', while the ring 4' of the lower working roll 2' is positioned at the groove 3 of the upper working roll 2.

In this position, the dimensioning of the different parts of the working rolls, in particular, the diameter of the rings 4, 4', of the liners 8, 8' and of the grooves 3, 3', is such that the upper working roll 2 and the lower working roll 2' may also be positioned, under limit conditions, with the liners 8, 8' thereof in contact. This occurs, for example, at the beginning of the production campaign when working rolls are replaced and the position thereof is zeroed in view of the next production cycle.

The width of the grooves 3, 3' is higher than the width of the rings 4, 4' along the axes X, X'. A further groove 9, 9' may be provided between the rolls 2, 2' and the rings 4, 4'.

Figure 2:
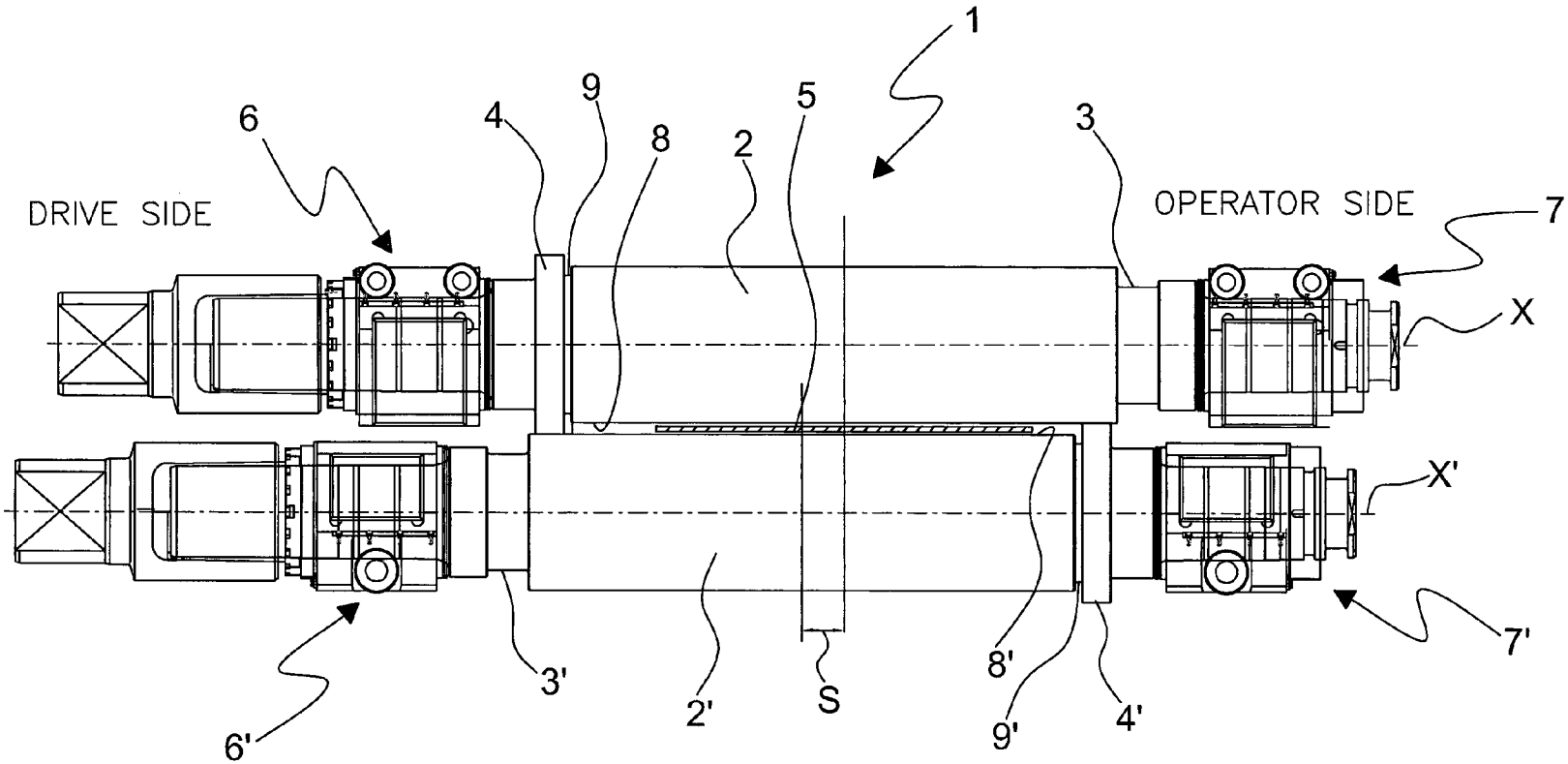
FIG. 2 is a view of the working rolls of a rolling stand according to the invention in rolling stand zeroing position.

When the working rolls 2, 2' are inserted in the rolling stand, during the step of setting up the rolling train or during the step of replacing the worn working rolls, the position of the working rolls 2, 2' is zeroed by means of a translation of at least one of the two working rolls 2, 2' along the respective longitudinal axis X, X' so as to obtain the configuration of the zeroing position, shown in FIG. 2. Before proceeding with this axial translation, an opening operation of the working rolls 2, 2' is carried out in a known way, i.e., a distancing operation of the working rolls by means of further hydraulic cylinder systems and/or mechanical systems, in a manner at least sufficient to allow the axial translation of at least one of the working rolls without any interference between the ring 4, 4' of one working roll and the liner 8', 8 of the other working ring.

In this zeroing position, the ring 4 of the upper working roll 2 is positioned in contact with the rolling surface or liner 8' of the lower working roll 2' while the ring 4' of the lower working roll 2' is positioned in contact with the rolling surface or liner 8 of the upper working roll 2. This zeroing position may be advantageously reached while the strip 5 crosses the gap present between the two working rolls 2, 2'. Advantageously, the zeroing system, according to the present invention, is provided with auxiliary supporting rolls to maintain the passline of the material at a constant value while the working rolls are changed. Consequently, the material to be rolled may continue to cross the gap between the working rolls 2, 2' without being rolled, as shown in FIG. 2.

Advantageously, the diameter D1 of the rings 4, 4' and the diameter D3 of the grooves 3, 3' are appropriately defined according to the thickness of the material to be rolled during the step of designing.

In particular, contemplating the passage in the rolling stand of a strip having thickness H, diameter D1 of the rings 4, 4' is at least equal to: D1=D2+2H.

The outer surface of the rings 4, 4' is ground along with the rolling surface or liner 8, 8' to always guarantee a correct alignment and a correct concentricity of the rings with respect to the rolling cylinders.

The axial translation of at least one of the two working rolls 2, 2' to reach the zeroing position (FIG. 2) is equal to a predetermined length S, e.g., a defined shifting length.

Advantageously, the translation or moving means 10 are configured to translate at least one of the working rolls 2, 2' along the respective longitudinal axis X, X' by a predetermined length so that the following mathematical relationship is satisfied:

$$\tfrac{1}{2}(G+Tc-Wm-A-2e)\geq S\geq G/2+f+A/2$$

where:

S=shifting length, i.e., the value of the relative shill between the working rolls 2, 2' along the respective longitudinal axes X, X';

G=width of the groove 3, 3' along the longitudinal axis X, X';

Tc=table of the cylinder, i.e. the width of the rolling surface 8, 8' along the longitudinal axis X, X';

Wm=maximum width, along the longitudinal axis X, X', of the material (strip) to be rolled;

e=positioning error of the material to be rolled with respect to the working roll measured along the longitudinal axis X, X', i.e., the possible difference between vertical center line plane of the material to be rolled and the vertical center line plane of the working roll 2, 2' in rolling position;

f=width of a chamfer of the working roll 2, 2' between groove 3, 3' and rolling surface 8, 8', measured along the longitudinal axis X, X';

A=width of the ring 4, 4' along the longitudinal axis X, X'.

The presence of the rings 4, 4' on the working rolls 2, 2' does not interfere with the respective supporting or back-up rolls (not shown) contemplated in the rolling stand. The elements and features illustrated in the various embodiments may be combined to each other without departing from the scope of protection of the invention.

The invention claimed is:

1. A zeroing system of a rolling stand comprising:

a first working roll defining a first longitudinal axis, a second working roll defining a second longitudinal axis, wherein each of said first working roll and second working roll is provided at a first end with a respective annular protrusion having a first diameter $D_1$ larger than a second diameter $D_2$ of the working roll at a respective rolling surface, and provided at a second end with a respective annular recess having a third diameter $D_3$ smaller than said second diameter $D_2$, and wherein said first working roll and second working roll are configured so that in a rolling position, the annular protrusion of the first working roll is placed at the annular recess of the second working roll, while the annular protrusion of the second working roll is placed at the annular recess of the first working roll, and in a zeroing position of said working rolls, the annular protrusion of the first working roll is in contact with the rolling surface of the second working roll, while the annular protrusion of the second working roll is in contact with the rolling surface of the first working roll, whereby a material to be rolled may continue to cross a gap between said first and second working rolls without being rolled.

2. A system according to claim 1, wherein there are provided a translation mechanism for translating at least one of said first working roll and second working roll along the respective longitudinal axis whereby said first working roll and said second working roll pass from said rolling position to said zeroing position, or from said zeroing position to said rolling position.

3. A system according to claim 1, wherein for each working roll, the respective annular protrusion, the respective rolling surface and the respective annular recess are coaxial to one another.

4. A system according to claim 1 wherein the first diameter $D_1$ is at least: $D_1=D_2+2H$ where H is a thickness of the material to be rolled in the rolling stand.

5. A system according to claim 2, wherein said translation mechanism are configured to translate at least one of said first working roll and said second working roll along the respective longitudinal axis over a predetermined length so that the following mathematical relationship is satisfied:

$$\frac{1}{2}(G+Tc-Wm-A-2e)\geq S\geq\frac{G}{2}+f+\frac{A}{2}$$

where:

"S" is a value of a relative axial shifting between said first working roll and said second working roll;

"G" is the width of the annular recess measured along the respective longitudinal axis;

"Tc" is the width of the rolling surface measured along the respective longitudinal axis;

"Wm" is a maximum width along the longitudinal axis of the material to be rolled between said first and second working rolls;

"e" is a positioning error with respect to the first working roll and to the second working roll measured along the respective longitudinal axis;

"f" is the width of a chamfer provided between the annular recess and the rolling surface of each of said first working roll and said second working roll, measured along the longitudinal axis;

"A" is the width of the annular protrusion measured along the respective longitudinal axis.

6. A system according to claim 1, wherein the annular recesses are wider than the annular protrusions along the respective longitudinal axis.

7. A system according to claim 2 or 5, wherein the translation mechanism comprises at least one shifting device provided with hydraulic cylinders.

8. A system according to claim 1, wherein the annular protrusions and the annular recesses are integrally made on the respective working roll.

9. A system according to claim 1, wherein the annular protrusions are mechanically assembled the respective working roll.

10. A system according to claim 1, wherein the first working roll and the second working roll are supported by respective fittings on a drive side and by respective further fittings on an operator side.

11. A rolling stand comprising a zeroing system for zeroing a position of working rolls, said zeroing system comprising:

a first working roll defining a first longitudinal axis, a second working roll defining a second longitudinal axis, wherein each of said first working roll and second working roll is provided at a first end with a respective annular protrusion having a first diameter larger than a second diameter of the working roll at a respective rolling surface, and provided at a second end with a respective annular recess having a third diameter smaller than said second diameter, and wherein said first working roll and second working roll are configured so that in a rolling position, the annular protrusion of the first working roll is placed at the annular recess of the second working roll, while the annular protrusion of the second working roll is placed at the annular recess of the first working roll, and in a zeroing position of said working rolls, the annular protrusion of the first working roll is in contact with the rolling surface of the second working roll, while the annular protrusion of the second working roll is in contact with the rolling surface of the first working roll, whereby a material to be rolled may continue to cross a gap between said first and second working rolls without being rolled.

12. A zeroing process for zeroing a position of working rolls of a rolling stand by means of a zeroing system comprising:

a first working roll defining a first longitudinal axis, a second working roll defining a second longitudinal axis, wherein each of said first working roll and second working roll is provided at a first end with a respective annular protrusion having a first diameter larger than a second diameter of the working roll at a respective rolling surface, and provided at a second end with a respective annular recess having a third diameter smaller than said second diameter, and wherein said first working roll and second working roll are configured so that in a rolling position, the annular protrusion of the first working roll is placed at the annular recess of the second working roll, while the annular protrusion of the second working roll is placed at the annular recess of the first working roll, and in a zeroing position of said working rolls, the annular protrusion of the first working roll is in contact with the rolling surface of the second working roll, while the annular protrusion of the second working roll is in contact with the rolling surface of the first working roll, whereby a material to be rolled may continue to cross a gap between said first and second working rolls without being rolled;

the process comprising the following stages:

a) inserting said first working roll and second working roll into the rolling stand in said rolling position;

b) translating at least one of said first working roll and said second working roll along the respective longitudinal axis until reaching a predetermined axial shifting between the working rolls whereby said zeroing position is reached.

13. Process according to claim 12, wherein before the stage b) there is provided a step of opening said first working roll and second working roll whereby the subsequent axial translation of at least one of the first and second working rolls occurs without interference between the annular protrusion of the first working roll and the rolling surface of the second working roll, and without interference between the annular protrusion of the second working roll and the rolling surface of the first working roll.

* * * * *